US010299565B2

(12) United States Patent
Sanchez et al.

(10) Patent No.: US 10,299,565 B2
(45) Date of Patent: May 28, 2019

(54) APPLICATOR FOR APPLYING A PRODUCT TO THE EYELASHES AND/OR EYEBROWS

(71) Applicant: L'Oreal, Paris (FR)

(72) Inventors: Marcel Sanchez, Aulnay sous Bois (FR); Eric Caulier, Maignelay (FR); Wendy Annonay, Paris (FR)

(73) Assignee: L'OREAL, Paris (FR)

( * ) Notice: Subject to any disclaimer, the term of this patent is extended or adjusted under 35 U.S.C. 154(b) by 73 days.

(21) Appl. No.: 14/896,615

(22) PCT Filed: Jun. 6, 2014

(86) PCT No.: PCT/IB2014/062009
§ 371 (c)(1),
(2) Date: Dec. 7, 2015

(87) PCT Pub. No.: WO2014/195914
PCT Pub. Date: Dec. 11, 2014

(65) Prior Publication Data
US 2016/0135568 A1 May 19, 2016

(30) Foreign Application Priority Data
Jun. 6, 2013 (FR) ..... 13 55191

(51) Int. Cl.
*A45D 40/26* (2006.01)
*A46B 1/00* (2006.01)
(Continued)

(52) U.S. Cl.
CPC ..... *A45D 40/265* (2013.01); *A46B 1/00* (2013.01); *A46B 3/005* (2013.01); *A46B 9/021* (2013.01);
(Continued)

(58) Field of Classification Search
CPC ..... A45D 40/262; A45D 40/265; A46B 1/00; A46B 1/0238; A46B 3/005; A46B 9/021; A46B 2200/1053
See application file for complete search history.

(56) References Cited

U.S. PATENT DOCUMENTS 6,412,496 B1 † 7/2002 Gueret
6,581,610 B1 † 6/2003 Gueret
2012/0294664 A1 11/2012 Gueret

FOREIGN PATENT DOCUMENTS

CN 102573559 A 7/2012
FR 2937514 A1 4/2010
(Continued)

OTHER PUBLICATIONS

Oct. 26, 2016 Office Action issued in European Patent Application 14731820.8.
(Continued)

*Primary Examiner* — Rachel R Steitz
(74) *Attorney, Agent, or Firm* — Oliff PLC

(57) ABSTRACT

The invention concerns an applicator for applying a product to the eyelashes and/or eyebrows, comprising a molded application member which includes: a core with a longitudinal axis; teeth each extending outwards from the core in the direction of a free end of the tooth; at least one tooth, preferably a row of teeth, particularly preferably all the teeth, having, in elevation, a dissymmetrical shape and a convex edge, the tooth or teeth tapering both over at least part of the height thereof upwards and towards the convex edge.

19 Claims, 7 Drawing Sheets

Figure 1:
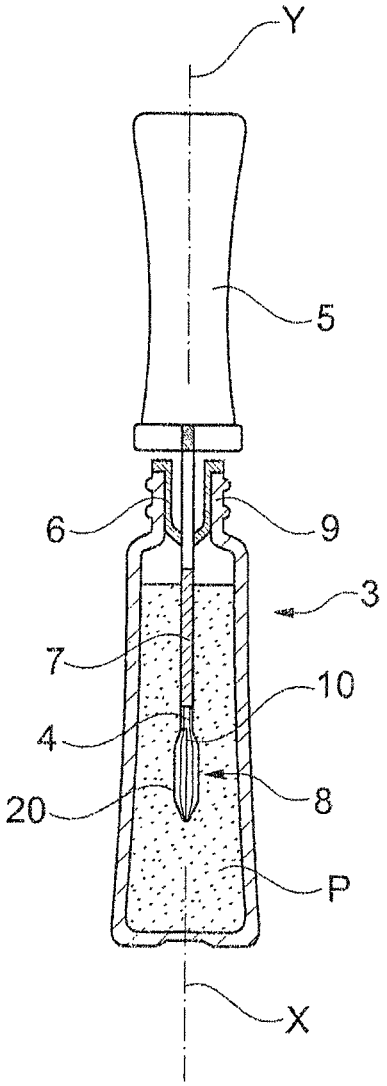

(51) Int. Cl.

| | |
|---|---|
| ***A46B 3/00*** | (2006.01) |
| ***A46B 9/02*** | (2006.01) |
| ***A46D 1/00*** | (2006.01) |

(52) U.S. Cl.
CPC .... *A46D 1/0238* (2013.01); *A46B 2200/1053* (2013.01)

(56) References Cited

FOREIGN PATENT DOCUMENTS

| | | | |
|---|---|---|---|
| WO | 2010/013213 | A2 | 2/2010 |
| WO | 2012/011022 | A1 | 1/2012 |

OTHER PUBLICATIONS

Oct. 16, 2014 Search Report issued in International Patent Application No. PCT/IB2014/062009.
Oct. 16, 2014 Written Opinion issued in International Patent Application No. PCT/IB2014/062009.
Aug. 9, 2016 Third Party Observation for Patent Application No. 140731820.8.
Jul. 25, 2016 Office Action issued in Chinese Patent Application No. 201480044097.4.
D.V. Rosato and Marlene G. Rosato, Injection Molding Handbook, p. 16, 2012, Springer Science & Business Media.†

† cited by third party

APPLICATOR FOR APPLYING A PRODUCT TO THE EYELASHES AND/OR EYEBROWS

The present invention relates to an applicator for applying a product to the eyelashes and/or eyebrows, having a molded applicator member, and to a packaging and application device having such an applicator.

A large number of applicators having an applicator member that has a core and teeth molded in one piece with the core have already been proposed.

Applications EP 1 070 466 and FR 2 837 077 disclose a comb having two rows of teeth, the teeth in each row having a flattened cross section that tapers toward their free end.

FR 2 962 888 discloses a brush having teeth with an asymmetrical shape.

Applications FR 2 961 384 and FR 2 922 422 disclose a brush having teeth with asymmetrical shapes in front view, having a first longitudinal face with a flat shape and a second longitudinal face with a rounded, in particular convex, shape, the teeth tapering toward their free end.

There is a need to further improve applicators having a molded applicator member in order to allow the user to apply makeup such that the eyelashes are loaded and separated as effectively as possible.

There is also a need to benefit from an applicator that makes it possible to apply makeup to the eyelashes or eyebrows, which are or are not already coated with product, by bunches.

SUMMARY

A subject of the invention, according to one of its aspects, is an applicator for applying a product to the eyelashes and/or eyebrows, having a molded applicator member, this applicator member having:

a core having a longitudinal axis, teeth that each extend outward from the core in the direction of a free end of the tooth, at least one tooth, better still a row of teeth, even better still all of the teeth having, in front view, an asymmetrical shape and a convex edge, the tooth becoming thinner both upward over at least a part of its height and toward the convex edge.

Such a tooth shape can be referred to as a "half petal". This shape makes it possible, when the brush is used with a cosmetic product, in particular mascara, to promote the retention of product on the teeth, and to have a relatively large contact surface between the eyelashes and the teeth, this making it possible to properly load the eyelashes with product during application.

The fact that the tooth becomes thinner upward over at least a part of its height also promotes the separation of the row of eyelashes, in order, during application or combing, to produce a multitude of bunches of eyelashes that are well defined and to prevent the formation of excessively large clumps of eyelashes.

The fact that the tooth becomes thinner toward the convex edge makes it possible to guide the eyelashes right from their first contact with the brush, and facilitates their proper engagement between the teeth.

The invention makes it possible to obtain, if so desired by the user, a makeup result with the eyelashes and/or eyebrows in bunches, that is to say with the eyelashes grouped in small distinct clumps, thereby organizing the eyelashes and giving them volume.

A tooth is seen in front view when it is seen in projection on a plane perpendicular to the longitudinal axis of the core.

The expression "longitudinal axis of the core" denotes the line connecting all of the centers of mass of the cross sections of the core. The longitudinal axis may be a central axis, or even an axis of symmetry for the core, in particular when the core has a circular cross section or a cross section in the overall shape of a regular polygon. The longitudinal axis of the core may be rectilinear or curved and may be contained in a plane, which may be a plane of symmetry for some, or even for all of the cross sections of the core. Preferably, the longitudinal axis of the core is rectilinear.

The expression "tooth" denotes an individualizable projecting element that is used to apply the product and to separate the eyelashes and is produced in accordance with the invention.

The expression "a tooth having, in front view, an asymmetrical shape" denotes a tooth made such that, when it is seen in front view, the tooth does not have a plane of symmetry. Such a tooth preferably has left-hand and right-hand edges with different shapes.

The expression "convex edge" denotes an edge of the tooth, when it is seen in front view, that has a curvature rounded toward the outside of the tooth.

The expression "the tooth becoming thinner upward over at least a part of its height" should be understood as meaning that the maximum thickness measured in its cross section decreases upward in the direction of its free end.

The expression "the tooth becoming thinner toward the convex edge" should be understood as meaning that, in cross section, the thickness of the tooth decreases the closer it is to the convex edge.

Preferably, the tooth extends above the core over its entire height, from its base, by which it is connected to the core, to its free end.

Preferably, the tooth becomes thinner upwards over its entire height and can taper in the direction of its free end. The free end can then constitute a point.

In one variant, the tooth does not become continuously thinner over its entire height and has in particular a narrowing in its cross section, preferably close to the core. Nevertheless, the tooth can become thinner upward over at least half of its height. Such a narrowing can create a cavity that is favorable for the accumulation of product and/or can make the tooth more flexible.

The expression "flattened cross section" should be understood as meaning that the tooth has, over at least a part of its height, a cross section, measured perpendicularly to its direction of elongation, which has an elongate shape in a flattening plane, that is to say is wider than it is thick. Preferably, the tooth is flattened in a direction perpendicular to the longitudinal axis of the core.

The tooth may have a flattened cross section over preferably at least half of its height, better still its entire height or possibly only above a narrowing in its cross section near to the base of the tooth. The tooth may be flattened in a flattening plane perpendicular to the longitudinal axis of the core.

The teeth preferably extend from a single base, with a closed contour when seen along the axis of the tooth.

Preferably, the teeth are solid. The teeth preferably have a substantially pointed free end. The circumferential extension of each tooth about the core may be less than 180°, better still 90°.

Preferably, the teeth taper at their distal end so as to form a point. The tangents to the surface of the tooth in front view, taken at 90% of the height of the tooth, may form an angle of less than or equal to 90° between one another.

The convex edge may be an angular edge of the tooth and may constitute, in cross section through the tooth, a ridge.

The convex edge may extend over at least half the height of the tooth, better still over the entire height of the tooth, specifically from the base to the free end of the tooth.

The convex edge may have a profile in the shape of a portion of an ellipse, of a circle or of a parabola.

The tooth may have, in front view, a rectilinear edge which extends over at least half the height of the tooth, better still from the base to the free end of the tooth. The tooth may have a flat face defining said rectilinear edge. The flat face may be oriented radially with respect to the longitudinal axis of the core and is preferably situated away from the convex edge. The tooth may become thinner from the flat face to the convex edge, this thinning being preferably continuous. The flat face may be perpendicular to the core, at its base.

The tooth may have, in front view, a concave edge which extends over at least half the height of the tooth, better still from the base to the free end of the tooth.

Preferably, the angular extension at the base of the tooth, at the junction with the core, defines the overall angular extension of the tooth about the longitudinal axis of the core. Preferably, the tooth is inscribed, in front view, in a rectangle with a width equal to the greatest transverse dimension of the tooth in front view.

The tooth may have two opposite main longitudinal faces, which are flat or curved, in particular domed, and each have for example the shape of a portion of a quadric, in particular a portion of an ellipsoid, of a hyperboloid or of a paraboloid, or a portion of a cone. The two opposite main faces may connect the flat face defining the rectilinear edge of the tooth to the ridge or to the surface defining the convex edge.

The cross section of the tooth, taken perpendicularly to its direction of elongation, may have an approximately triangular shape.

The greatest width of the tooth, in cross section, may be less than or equal to 2 mm, better still less than or equal to 1.5 mm. This greatest width may be defined as the greatest dimension of the tooth parallel to the flattening plane Z of the tooth. It is in particular measured at its base, when the tooth becomes continuously thinner from its base to its free end. The height of the tooth may be less than or equal to 5 mm, the height of the tooth being the dimension of the tooth along its longitudinal axis. The maximum thickness of the tooth may be between 0.2 mm and 1 mm, better still between 0.4 mm and 0.7 mm, the maximum thickness of the tooth being, in cross section through the tooth, the dimension of the tooth in the direction at right angles to that of the greatest width. The thickness of the tooth may be measured parallel to the longitudinal axis of the core when the flattening plane of the tooth is perpendicular to the longitudinal axis of the tooth. The maximum thickness of the tooth may be situated at its base, in particular when the tooth becomes continuously thinner in the direction of its free end.

The ratio of the greatest width of the tooth to its height is preferably between 0.5 and 2.

In one variant, the tooth has at least one notch or a recess and/or an indentation in its surface. The tooth may also have a through-opening and/or be at least partially flocked.

The tooth may be made of the same material as a part of the core, better still all of the core. The tooth may thus be injection-molded from thermoplastic material with at least a part of the core, better still all of the core.

The core may have a circular or polygonal, in particular hexagonal, cross section. The teeth may be attached to one and the same flat face of the core over more than half of their greatest width. Preferably, the teeth extend over virtually their entire width, at their base, from one and the same flat face of the core.

In one variant, the core is twisted.

In the preceding text, a number of embodiment details have been set out with regard to a tooth. Of course, a plurality of teeth can have the same features, which are preferably common to all of the teeth of the applicator member.

The molded applicator member may have at least two adjacent teeth, constituting a pair of teeth, these teeth being as defined above, the convex edges of these two teeth being situated away from one another. The adjacent teeth may succeed one another along the core. The applicator member preferably has a number of rows of such pairs of teeth.

The expression "convex edges situated away from one another" should be understood as meaning that, in front view, if the convex edge of the first tooth, closest to the observer, is oriented toward the right, then the convex edge of the second tooth is oriented toward the left, and vice versa.

The teeth can be offset on the core, along and about the longitudinal axis of the core. The two teeth may extend in directions which, in front view, are at a nonzero angular separation from one another, the latter being defined by the angle between the radius of the core passing through the middle of the arc of intersection of the first tooth with the core and the radius of the core passing through the middle of the arc of intersection of the second tooth with the core. The angular separation between the two teeth may be between 15° and 45°. The two teeth may be spaced apart longitudinally by a distance of between 0.5 mm and 3 mm.

Preferably, in front view, the convex edge of the tooth that is offset toward the right is oriented toward the right and the convex edge of the tooth that is offset toward the left is oriented toward the left, the two convex edges then being oriented toward the outside of the corresponding pair of teeth.

Preferably, the two teeth are partially superposed in front view over at least a part of their height, better still over more than half of their height, even better still over their entire height. This superposition may only have a small extent, and the greatest width of overlap is for example less than or equal to 2 mm. This greatest width of overlap may occur at the base of the teeth.

The two teeth may or may not be the same height. When the two teeth are not the same height, the ratio of the height of one of the teeth to the other, namely m/n, is preferably between 0.1 and 0.9, m being the height of the smallest tooth and n being the height of the largest tooth.

A further subject of the invention is a packaging and application device having:

an applicator according to the invention, as defined above, a container containing a product to be applied to the eyelashes or eyebrows with the aid of the applicator.

A further subject of the invention is a method for making up the eyelashes and/or eyebrows with the aid of an applicator according to the invention.

The product to be applied may be a mascara or a care product.

Figure 2:
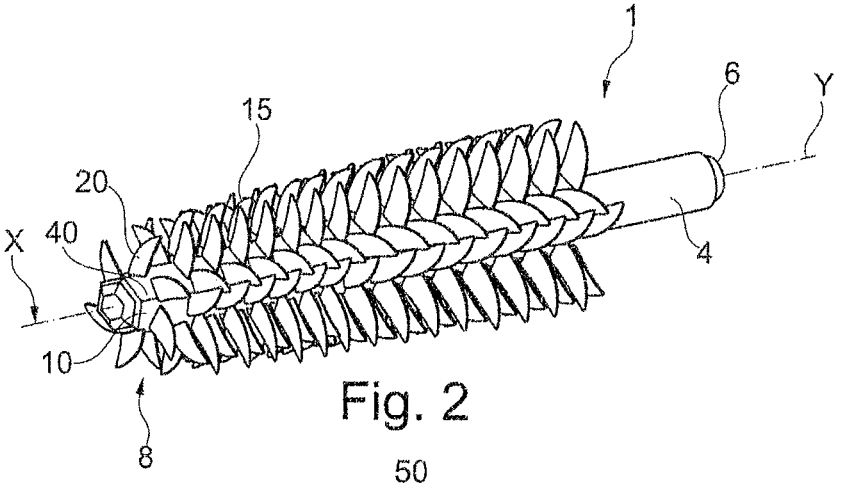
Figure 3:
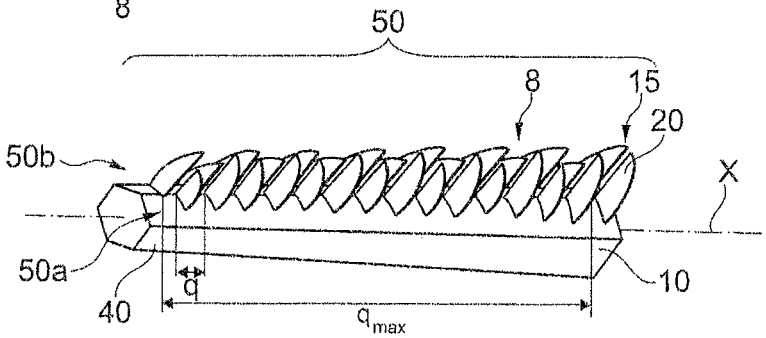
Figure 4:
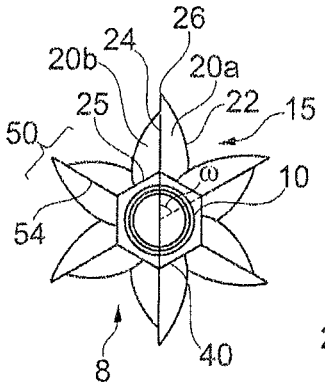
Figure 4A:
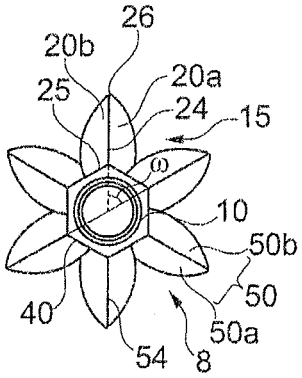
Figure 4B:
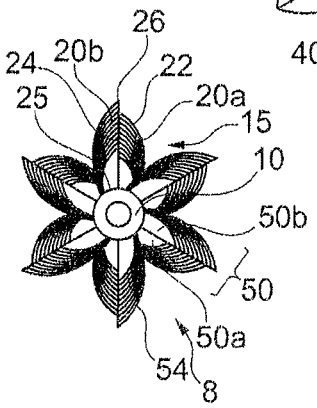
Figure 5:
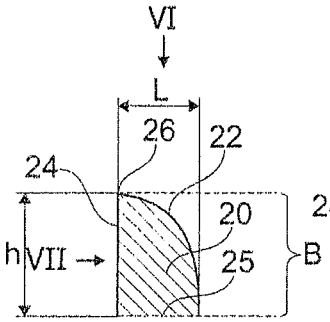
Figure 5A:
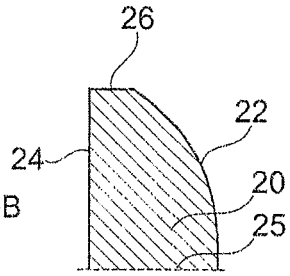
Figure 5B:
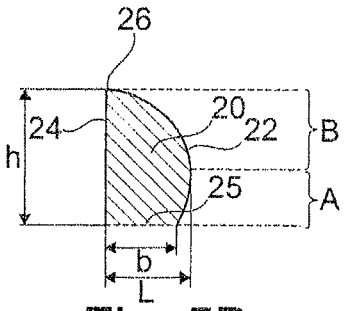
Figure 5C:
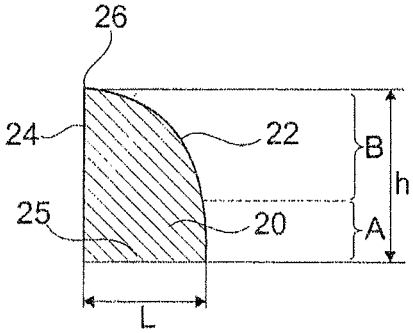
Figure 5D:
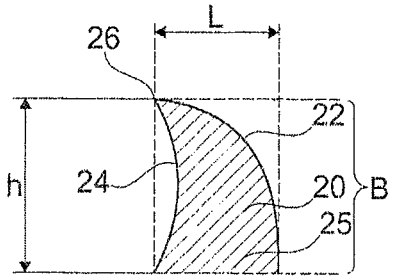
Figure 6:
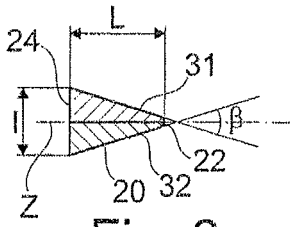
Figure 6A:
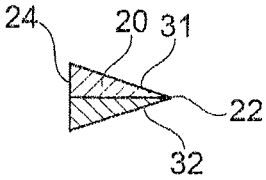
Figure 6B:
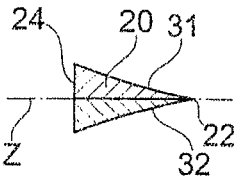
Figure 6C:
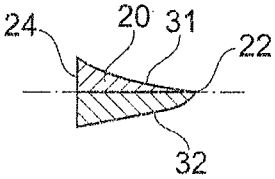
Figure 6D:
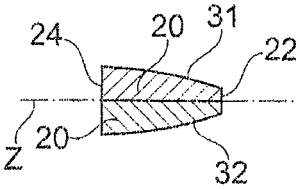
Figure 7:
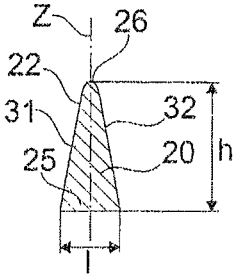
Figures 9A, 9B, 9C:
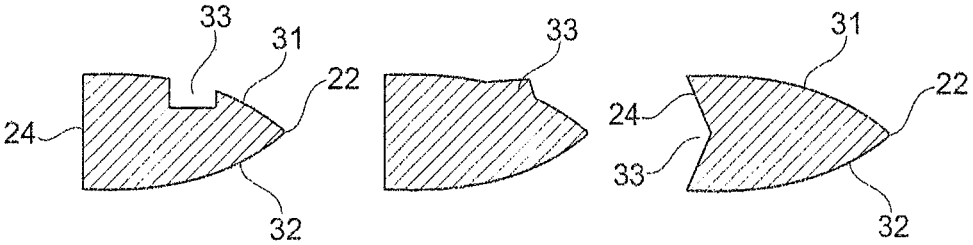
Figure 10:
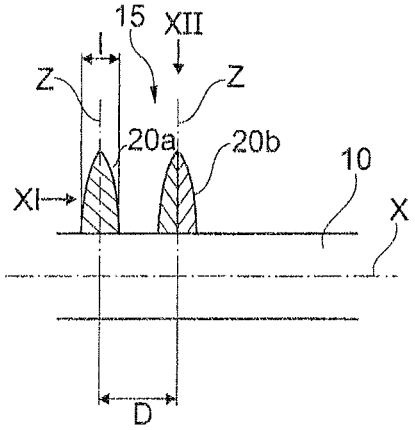
Figure 11:
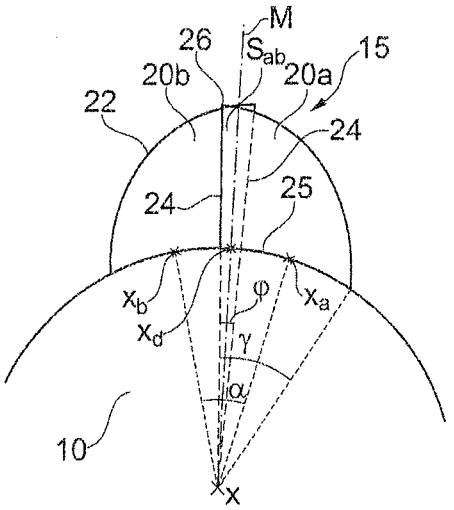
Figure 12A:
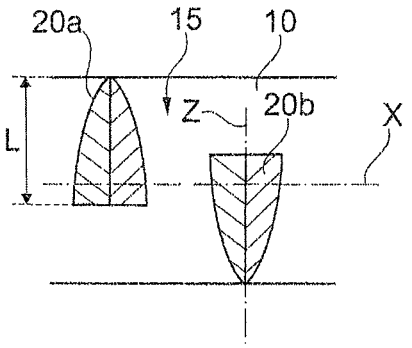
Figure 12B:
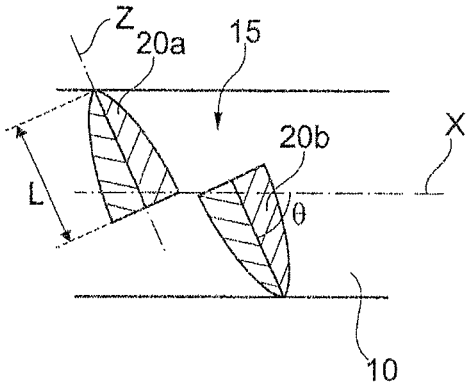
Figure 13:
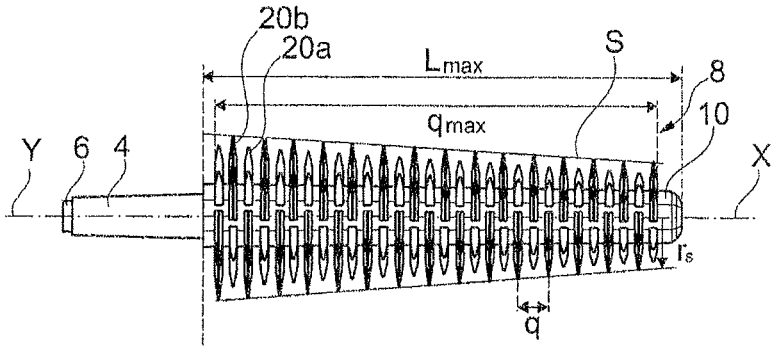
Figure 14:
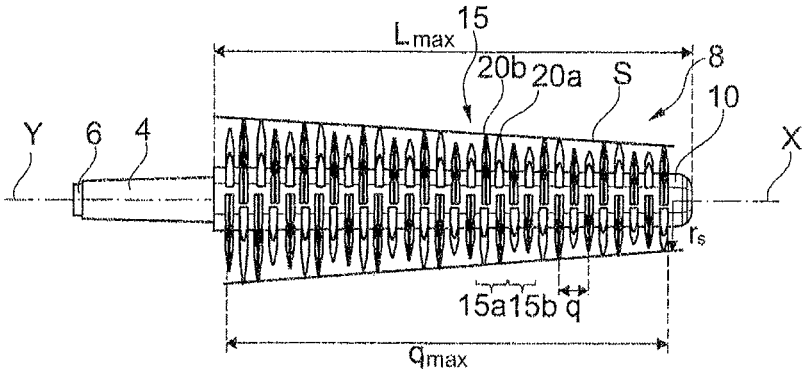
Figure 15:
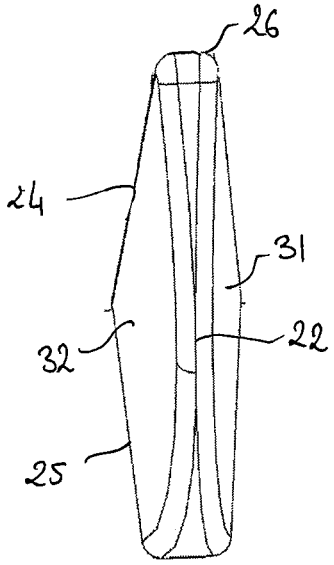

The invention may be better understood on reading the following detailed description of nonlimiting illustrative examples thereof and on examining the appended drawing, in which:

FIG. 1 is a schematic and partial view, in longitudinal section, of an example of a packaging and application device produced in accordance with the invention, FIG. 2 is a schematic perspective view of a brush according to one illustrative example of the invention, FIG. 3 is a schematic and partial view of a detail of the brush illustrated in FIG. 2, FIGS. 4 to 4B are schematic views of brushes according to the invention, in front view, FIG. 5 is a schematic view of a tooth according to the invention, seen in front view, FIGS. 6 to 6D are examples of possible tooth configurations, seen from above in the direction VI in FIG. 5, FIG. 7 is a schematic view of the tooth, seen from the side in the direction VII in FIG. 5, FIGS. 5A to 5E and 8A to 8D are views similar to FIG. 5 of variant embodiments of teeth, FIGS. 9A to 9C are views similar to FIG. 6 of variant embodiments of teeth, FIG. 10 is a schematic side view illustrating the relative positioning of successive teeth, FIG. 11 is a front view along XI in FIG. 10, FIGS. 12A and 12B are top views along XII in FIG. 10, FIGS. 13 and 14 are schematic side views of brushes according to further illustrative examples of the invention, and FIG. 15 is a schematic and isometric view of a tooth according to the invention.

FIG. 1 shows a packaging and application device having a container 3 containing a product P to be applied to the eyelashes and/or eyebrows and an applicator 1 for applying said product P. The applicator 1 has an applicator member 8 according to the invention, which is connected by a stem 7 to a gripping member 5 which also constitutes a member for closing the container 3. This closure member 5 is, for example, as illustrated, a cap designed to be screwed onto a neck 9 of the container. The container 3 may have a wiping member 6 for wiping the applicator 1, fixed in the neck 9 of the container 3.

The applicator member 8 has a core 10 bearing application elements 20, in particular teeth according to the invention, and spikes, if need be.

If need be, the stem 7 may have an annular narrowing at its portion that is positioned opposite the lip of the wiping member 6, so as not to mechanically stress the latter unduly during storage.

The applicator member 8 may be connected to the stem 7 in various ways and has for example, as illustrated, an end piece 4 designed to be fixed in a housing thereof. The applicator member 8 may be fixed to the stem 7 by any means, and in particular by force-fitting, stapling, snap-fastening, adhesive bonding, welding or crimping, in the corresponding housing provided at the end of the stem 7.

As a variant, the stem 7 may be inserted into a housing provided in the core 10, or the stem and the core may be produced at least partly in one piece.

Core

As illustrated in FIGS. 2 and 3, the core has an elongate shape along a longitudinal axis X, which may be rectilinear or curved, preferably being rectilinear.

As illustrated in FIG. 4, the core 10 may have a polygonal, in particular hexagonal, cross section along the majority of its length, the sides of the core 10 defining longitudinal faces 40. The latter may all be provided with application elements 20, in particular teeth. The faces 40 may be curved or, as in the example illustrated, flat. In one variant, which is not illustrated, only a part of the faces of the core 10 bears application elements 20.

As a variant, and as illustrated in FIG. 4B, the core 10 may have a circular cross section along the majority of its length.

As illustrated, the longitudinal axis X may be central and the core 10 may be inscribed in cross section in a circle having a diameter less than or equal to 5 mm.

As illustrated in FIGS. 2 and 3, the cross section of the core 10 may widen in the direction of the end piece 4. As a variant, the cross section of the core 10 may become thinner in the direction of the end piece 4. As a variant, the core 10 may have a constant cross section, and in particular have a cylindrical shape.

The core 10 may be hollow, the inside diameter of the core 10 preferably being between 1 mm and 2.5 mm.

At its distal end, the core 10 may have a head which tapers toward the free end 42 so as to make it easier to return the applicator 1 into the container 3.

The core 10 may be made of a thermoplastic material which is or is not relatively rigid, for example SEBS, a silicone, latex, butyl, EPDM, a nitrile, a thermoplastic elastomer, a polyester elastomer, a polyamide elastomer, a polyethylene elastomer or a vinyl elastomer, a polyolefin such as PE or PP, PVC, EVA, PS, PET, POM, PA or PMMA. It is possible in particular to use the materials known under the trade names Hytrel®, Carifiex®, Alixine®, Santoprene®, or Pebax®, this list not being limiting.

The core 10 may be produced in one piece with the stem 7 by being molded together therewith.

The core 10 may be twisted, the teeth 20 then following the twist produced by the core.

Teeth

The applicator member 8 has teeth 20 which each extend toward the outside from the core 10, in the direction of a free end 26.

Shape of the Teeth

As illustrated in the figures, at least one tooth 20, better still a row of teeth 20, even better still, as illustrated in FIG. 2, all of the teeth 20, has/have a convex edge 22 in front view. Said convex edge may, as illustrated in FIG. 5, be a curved portion, in particular a portion of a circle or of a parabola, and preferably a portion of an ellipse.

The convex edge 22 may extend over more than half the height h of each of the teeth 20, better still over the entire height h of each of the teeth 20, as illustrated in FIG. 5.

Each tooth 20 may become thinner, as illustrated in FIGS. 6 and 15, toward the convex edge 22 at, in particular, a vertex angle β, in cross section through the tooth 20. The angle β may be less than or equal to 40°, better still less than or equal to 15°. This thinning allows the eyelashes to be displaced as soon as they come into contact with the applicator 1. Preferably, the convex edge 22 defines a ridge.

As illustrated in FIG. 5, each tooth 20 becomes thinner upward, in front view, over at least a part B of its height, better still at least half of its height. The part B may extend from the base 25. The major dimension of the base 25 is for example between 0.3 mm and 3 mm.

Preferably, the free end 26 of each tooth is tapered in front view, as illustrated in FIG. 5, in particular forming a point which facilitates penetration into the eyelashes and the separation of the latter.

As illustrated in FIG. 6, each tooth 20 preferably has a flattened cross section over a part of its height, better still over more than half of its height, even better still over its entire height.

As illustrated in FIG. 12A more particularly, the flattening plane Z of the teeth 20 is preferably oriented perpendicularly to the core 10. The flattening plane Z is in particular a median plane of symmetry for the tooth 20.

As illustrated in FIGS. 5 and 6, each tooth 20 may have, in front view, a rectilinear edge 24, which is in particular radial with respect to the longitudinal axis X of the core 10, and extends over more than half the height h of the tooth 20, preferably over the entire height h of the tooth 20.

Preferably, as illustrated in FIGS. 5 to 5D, the tooth 20 is inscribed, in front view, in a rectangle with a width substantially equal to the greatest transverse dimension L of the tooth 20 in front view.

In the variant illustrated in FIG. 5D, each tooth 20 has, in front view, a concave edge 24, which extends over more than half the height h of the tooth 20, preferably over the entire height h of the tooth 20.

Each tooth 20 preferably has, as illustrated in particular in FIG. 6, a flat face 24 which defines this rectilinear edge. The flat face 24 is away from the convex edge 22 of the tooth 20. Preferably, each tooth 20 becomes thinner from the flat face 24 to the convex edge 22.

As illustrated in FIG. 15, each tooth 20 may have two opposite main longitudinal faces 31 and 32 which are flat or curved, being concave or preferably, as illustrated in FIG. 6, convex toward the outside. As illustrated in FIG. 6, the faces 31 and 32 are preferably portions of an ellipsoid.

Preferably, each tooth 20 has an angular extent γ which is equal to the angular extent of the base 25 of the tooth.

As illustrated in FIGS. 6 to 6C, the faces 31 and 32 are preferably the same shape. In the examples illustrated, the faces 31 and 32 connect the flat face 24 to the convex edge 22.

The greatest width L of each tooth 20, defined as the largest dimension of the tooth 20 on the flattening plane Z, may be between 0.3 mm and 2 mm, better still between 0.5 mm and 1.5 mm. This greatest width L is preferably measured from the base of the teeth 20, as illustrated in FIG. 5.

The height h of each tooth 20 may be between 0.5 mm and 1 cm, better still between 1 mm and 5 mm. The maximum thickness 1 of each tooth 20 may be between 0.2 mm and 2 mm, better still between 0.4 mm and 1.5 mm. This maximum thickness 1 may be measured at the base of the teeth 20. The thickness of each tooth 20 at its free end 26 may be less than or equal to 0.5 mm.

The ratio L/h of the greatest width L of the tooth 20 to the height h of the tooth 20 may be between 0.5 and 2.

Preferably, the teeth 20 are solid. As a variant, the teeth 20 may have an orifice which is or is not a through-orifice.

The teeth 20 may extend from a single base 25 with a closed contour. The circumferential extension γ of the teeth 20 on the core may be less than or equal to 180°, better still less than or equal to 90°.

The teeth 20 are preferably made of the same material as at least a part of the core 10, better still all of the core 10. The teeth 20 are preferably produced in one piece with the core 10 by molding of thermoplastic material.

Figure 5E:
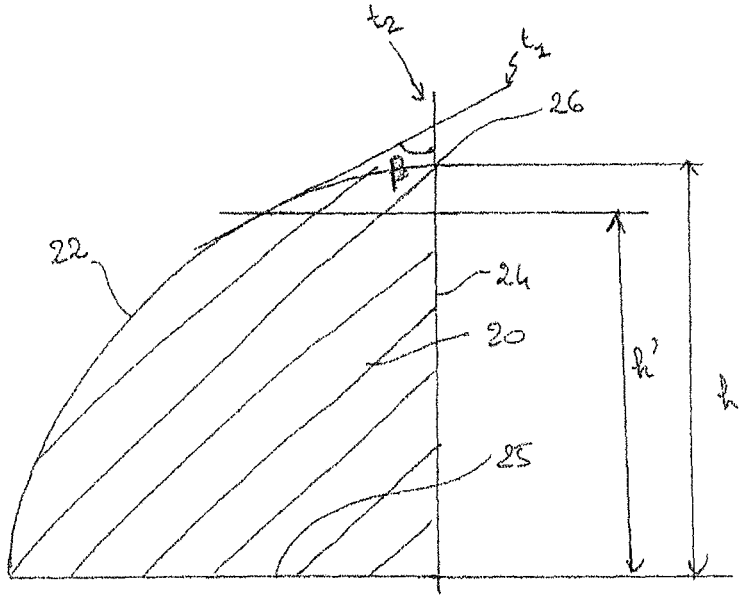
Figures 8A, 8B, 8C, 8D:
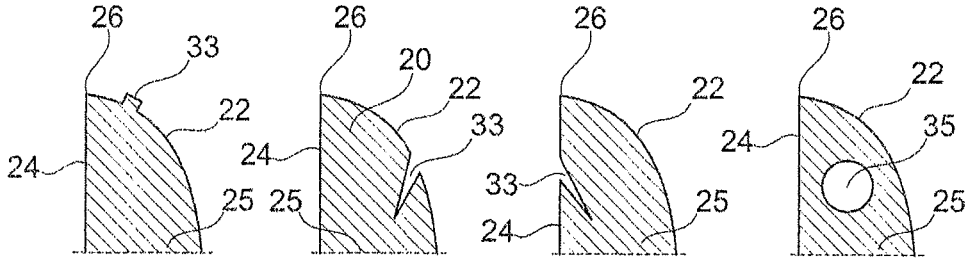

Preferably, as illustrated in FIG. 5E, the teeth 20 taper at their distal ends so as to form a point. Preferably, the tangents $t_1$ and $t_2$ to the surface of the tooth, taken, in front view, at a height h' equal to 90% of the height h of the tooth 20, form an angle β less than or equal to 90°.

As a variant, and as illustrated in FIGS. 5B and 5C, each tooth 20 does not become thinner over its entire height. Each tooth 20 may then have, over a part A of its height, a region with a constant width or a width that increases upward. This part A has a height which is preferably less than half the height h of the tooth 20.

In the variant illustrated in FIG. 5A, the free end 26 forms a flat. As a variant, as illustrated in FIG. 7, the end 26 may be rounded.

As illustrated in FIG. 6B, the faces 31 and 32 may be concave and are then for example portions of a hyperboloid or of a paraboloid. The faces 31 and 32 may also be flat, as illustrated in the example in FIG. 6A.

The faces 31 and 32 may also have different shapes, as illustrated in FIG. 6D.

As a variant, as illustrated in FIG. 12B, the flattening plane Z is oriented obliquely with respect to the longitudinal axis X of the core 10 at an angle θ of between 45° and 90°.

According to the variant illustrated in FIG. 5B, each tooth 20 has a narrowed base 25. The major dimension b of the base 25 is then for example between 0.1 mm and 1.5 mm.

In a variant that is not illustrated, the median axis of the flat face 24 does not extend perpendicularly to the axis X but obliquely with respect thereto, toward the front, that is to say the distal end of the applicator, or toward the rear.

As illustrated in FIGS. 8A to 9C, each tooth 20 may have a relief 33 such as an indentation, a recess and/or a notch in its surface. This relief 33 may be situated on the convex edge 22 and/or on the opposite face 24 of the tooth 20 and/or on the core and/or on the other of the opposite main faces 31 and 32. Each tooth 20 may also have an opening 35 passing through it, for example an opening with an axis perpendicular to the flattening plane Z.

The teeth 20 and the core 10 may be made of different materials, if need by, by bi-injection-molding. The teeth 20 are for example molded through openings in the core 10. The teeth 20 may be produced from a material softer than the core or, as a variant, harder than the core.

Arrangement of Two Successive Adjacent Teeth

As illustrated in FIGS. 2 to 4B and 10 to 12B, the core 10 may have on its surface at least one pair 15 of adjacent teeth, better still at least one row of pairs 15 of adjacent teeth, even better still, as illustrated in FIG. 2, a plurality of rows of pairs 15 of adjacent teeth, such as the teeth 20 described above.

The two teeth 20*a* and 20*b* of a pair can be the same height, as illustrated in FIG. 4A, or have different heights, as illustrated in particular in FIG. 4. This latter figure shows that the tooth 20*a* is slightly higher than the adjacent tooth 20*b*, which is situated in front of it, that is to say is closer to the distal end of the applicator.

As illustrated in FIG. 11, the convex edge 22 of the first tooth 20*a* can be oriented to the right in front view, while the convex edge 22 of the second tooth 20*b* can be oriented to the left, or vice versa. This opposite orientation of the convex edges 22 makes it possible for the brush to be used in either direction while producing the same effect.

The teeth 20*a* and 20*b* are preferably offset axially by a distance D, the latter being the distance between the flattening planes Z of the two teeth 20*a* and 20*b*. The distance D may be between 0.5 mm and 3 mm, better still between 0.5 mm and 1.5 mm.

The teeth 20*a* and 20*b* are preferably offset about the longitudinal axis X of the core. The angular spacing α between the two teeth 20*a* and 20*b*, which is defined, in front view, by the angle α between the radius of the core 10 passing through the middle $X_a$ of the arc of intersection of the first tooth 20*a* with the core 10 and the radius of the core 10 passing through the middle $X_b$ of the arc of intersection of the second tooth 20*b* with the core 10, is preferably between 15° and 60°.

The teeth 20*a* and 20*b* can be superposed at least partially over at least a part of the height h of the two teeth 20*a* and 20*b*, better still, as can be seen in FIG. 11, over the entire height of at least one of the teeth 20*a* or 20*b*. The angular spacing α between the two teeth 20*a* and 20*b* is less than the angular extents γ taken up by each of the teeth 20*a* and 20*b*, the latter being defined by the angle taken up by the tooth at its base. As illustrated in FIG. 11, the angle of overlap φ, defined, in front view, as the angle taken up by the area of superposition Sab between the two teeth 20*a* and 20*b* with respect to the longitudinal axis X, i.e. γ-α, may be less than or equal to 30°.

As illustrated in FIGS. 4, 4B and 13, the first tooth 20*a* may be larger than the second tooth 20*b*, or vice versa. The ratio of the heights m/n is preferably between 0.1 and 0.9, 111 being the height of the small tooth and n being the height of the large tooth.

As illustrated in FIGS. 11 and 4A, the teeth 20*a* and 20*b* may be the same height, the first tooth 20*a* preferably being, in front view, the mirror image of the second tooth 20*b* with respect to a plane of symmetry M parallel to the longitudinal axis X of the core 10.

Rows of Teeth

As illustrated in FIGS. 2, 4B and 14, the applicator member 8 may have at least one row 50 of pairs 15 of teeth, better still a plurality of rows 50 of pairs 15 of teeth, the pairs 15 of teeth having teeth 20*a* and 20*b* as described above. The rows 50 preferably extend along the longitudinal axis X of the core 10.

The applicator member 8 may have at least two rows 50 of pairs 15 of teeth, better still at least four rows 50, even better still at least six rows 50 disposed around the longitudinal axis X of the core 10.

All the rows 50 of the applicator member 8 are preferably identical.

The teeth of each of the rows 50 preferably have the same abscissa, along the longitudinal axis X, as the teeth of the same rank in the adjacent rows 50. Thus, the teeth of the same rank appear to be aligned when the applicator member is seen from the side.

The rows 50 are preferably spaced apart regularly around the longitudinal axis X of the core 10.

As illustrated in FIGS. 4 to 4B, the angular spacing ω between two consecutive rows 50, around the longitudinal axis X of the core 10, is preferably constant, the angular spacing ω being defined, in front view, by the angle between the radii of the core 10 which pass through the centers of mass of said rows. The angular spacing ω is preferably between 15° and 95°, better still between 45° and 75°, even better still equal to 60°.

Such rows 50 can be referred to as "double rows" on account of the presence of two distinct alignments 50*a* and 50*b* of respective teeth 20*a* and 20*b*.

As illustrated in FIG. 14, the axial distance q between two consecutive pairs 15 of teeth in the row 50 is preferably constant and between 0.8 mm and 4 mm, the axial distance q being defined by the distance, in side view, between the flattening planes Z of the first teeth 20*a* within the alignment 50*a* of teeth 20*a*.

The core preferably has a hexagonal cross section, as illustrated. The applicator member 8 preferably has six double rows 50, each double row 50 having its longitudinal axis disposed along a ridge of the core 10. The teeth 20*a* extend, over almost all of their base 25, over one of the flat faces 40 of the core 10, being attached to said ridge. The teeth 20*b* extend, over almost all of their base 25, over the other flat face 40, being attached to said ridge.

The envelope surface S of the teeth, defined by the free end 26 of the teeth 20, may be a surface of revolution, in particular a conical surface.

The radius $r_S$ of the envelope surface S preferably increases substantially in the direction of the end piece 4 along almost the entire length $q_{max}$ of the row 50.

Preferably, each alignment 50*a* and 50*b* has large teeth which alternate with small teeth, which are less high than the large teeth. The teeth of even rank of each alignment 50*a* and 50*b* are for example smaller than the teeth of odd rank, or vice versa. The ratio of the heights m/n is preferably between 0.1 and 0.9, m being the height of the small tooth and n being the height of the large tooth.

Each tooth of odd rank in the first alignment 50*a* is preferably the same height h as the adjacent tooth of even rank in the second alignment 50*b*. Each tooth of even rank in the first alignment 50*a* is preferably the same height h as the adjacent tooth of odd rank in the second alignment 50*b*. The teeth 20*a* and 20*b* are thus the same size for each pair of adjacent teeth in the double row 50.

Preferably, for each double row 50, the first alignment 50*a* is superposed at 54, as illustrated in FIG. 4, with the second alignment 50*b* of an adjacent double row 50. It is possible for this superposition to have only a small extent. The width of overlap defined, in front view, as the width at the base 25 of the region of overlap between the teeth, is for example less than or equal to 0.5 mm. As a variant, in front view, the teeth in adjacent rows 50 are not superposed.

The angular spacing ω between two consecutive rows 50, around the longitudinal axis X of the applicator member 8, may also, in one variant, vary around the core 10.

As illustrated in FIG. 13, the pairs 15 of teeth may have an increasing height with respect to one another along the longitudinal axis of the core along almost the entire length $q_{max}$ of the row 50. The height h of the teeth 20*a* and 20*b* in one row 50, better still in each of the rows 50 of teeth, may vary in an alternating manner along almost the entire length $q_{max}$ of the row 50. Each of the teeth 20*b* of even rank may be larger than the immediately adjacent teeth 20*a* of odd rank, or vice versa. The ratio m/n between two adjacent teeth is preferably between 0.1 and 0.9, m being the height of one of the small teeth and n being the height of one of the adjacent large teeth.

The teeth 20*a* and 20*b* in each alignment 50*a* and 50*b* may have an increasing height h with increasing distance from the distal end of the application, the teeth 20*a* in the first alignment 50*a* being smaller than the teeth 20*b* in the second alignment 50*b* of the same rank, or vice versa.

The distance D between two adjacent teeth 20*a* and 20*b* in one row 50 may be variable along at least half the length $q_{max}$ of the row 50.

The rows 50 of the applicator member 8 may differ from one another. The shape of the teeth 20*a* and 20*b* in two adjacent rows 50 may vary substantially, in particular by the height h of the corresponding teeth 20*a* and 20*b*. The teeth in one row 50 may all be larger than the teeth of the same rank in one of the adjacent rows 50.

As a variant, the teeth 20*a* and 20*b* of the same rank in adjacent rows 50 are not aligned about the longitudinal axis X. The teeth 20*a* and 20*b* of the same rank in adjacent rows 50 may be offset along the longitudinal axis X.

The invention is not limited to the case of double rows. The rows may be single and have one alignment of teeth 20 as described above or pairs 15 of aligned teeth 20*a* and 20*b*.

The invention is not limited to the exemplary embodiments which have just been described, the characteristics of which may be combined with one another as parts of variants which are not illustrated.

The applicator member may have spikes which can in particular be placed between the teeth, better still rows of spikes which can be placed between the rows of teeth.

The applicator member may be able to vibrate, that is to say that vibrations may be applied to it during application, combing or picking up of the product.

As a variant, the applicator member may be able to rotate, that is to say that it may be made to carry out a rotational movement about the longitudinal axis of the core, for example during application, combing of the eyelashes or the picking up of the product.

As a further variant, the applicator member is heated, that is to say it may have a heating element for heating the eyelashes and/or eyebrows, and/or the teeth and/or the core of the applicator member.

The applicator member may also be able to vibrate and/or be able to rotate and/or be heated.

The teeth may be flocked and as a result have a roughness or may undergo a chemical or mechanical treatment that promotes sliding on the eyelashes or eyebrows.

The expression "having a" should be understood as being synonymous with "having at least one", and "between" is understood as including the limits, unless specified to the contrary.

The invention claimed is:

1. An applicator for applying a product to the eyelashes and/or eyebrows, having a molded applicator member, this applicator member having:

a core having a longitudinal axis, teeth that each extend outward from the core in the direction of a free end of the tooth, at least one tooth having, in front view along the longitudinal axis of the core, an asymmetrical shape and having a convex edge constituting a ridge, said tooth or teeth comprising two opposite longitudinal main faces that both directly connect the ridge to a face opposite to the ridge, the ridge being at least partially formed by the intersection of the two opposite longitudinal main faces, said tooth or teeth becoming thinner upward over at least a part of their height and the tooth or teeth becoming in cross section thinner along a median plane of the tooth or teeth from the face opposite to the ridge toward the convex edge.

2. An applicator as claimed in claim 1, the tooth or teeth having a flattened cross section in a plane perpendicular to the longitudinal axis of the core.

3. An applicator as claimed in claim 1, a height h of the tooth being less than or equal to 5 mm.

4. An applicator as claimed in claim 1, a greatest width L of the tooth being less than or equal to 3 mm.

5. The applicator as claimed in claim 1, said tooth or teeth extending above the core over their entire height.

6. The applicator as claimed in claim 1, the tooth having, in front view, a concave edge extending over at least half the height of the tooth.

7. The applicator as claimed in claim 1, said tooth or teeth having a flattened cross section.

8. The applicator as claimed in claim 1, said tooth or teeth having a flat face.

9. The applicator as claimed in claim 8, said tooth or teeth becoming continuously thinner from the flat face to the convex edge.

10. The applicator as claimed in claim 1, said tooth or teeth each having two opposite main longitudinal faces that are flat and/or domed.

11. The applicator as claimed in claim 1, said tooth or teeth having an approximately triangular shape in cross section.

12. The applicator as claimed in claim 1, said tooth or teeth being molded together with at least a part of the core.

13. The applicator as claimed in claim 1, the applicator member having two adjacent teeth among said teeth, of which the convex edges are located away from one another.

14. The applicator as claimed in claim 13, the two teeth being offset on the core along and about the axis of the core.

15. The applicator as claimed in claim 13, the two teeth being partially superposed in front view over their entire height.

16. The applicator as claimed in claim 13, the ratio of the height h of one of the teeth to the other m/n being between 0.1 and 0.9, m being the height of the smallest tooth and n being the height of the largest tooth.

17. A packaging and application device having an applicator as defined in claim 1.

18. The applicator as claimed in claim 1, the tooth having, in front view, a rectilinear edge extending over at least half the height of the tooth.

19. An applicator for applying a product to the eyelashes and/or eyebrows, having a molded applicator member, this applicator member having:

a core having a longitudinal axis, teeth that each extend outward from the core in the direction of a free end of the tooth, at least two adjacent teeth each having, in front view, an asymmetrical shape and a convex edge constituting a ridge, said two adjacent teeth each comprising two opposite longitudinal main faces that both directly connect the ridge to a face opposite to the ridge, the ridge being at least partially formed by the intersection of the two opposite longitudinal main faces, said two adjacent teeth becoming thinner both upward over at least a part of their height and toward the convex edge, the teeth having, in front view, a rectilinear edge extending over at least half the height of the teeth, the convex edges of the two adjacent teeth being of opposite orientation, the two adjacent teeth being partially superposed in front view at their base.

* * * * *